US006722646B2

(12) United States Patent
Sekiyama et al.

(10) Patent No.: US 6,722,646 B2
(45) Date of Patent: Apr. 20, 2004

(54) SHEET TREATING APPARATUS AND IMAGE FORMING APPARATUS

(75) Inventors: Junichi Sekiyama, Shizuoka (JP); Yasuyoshi Hayakawa, Shizuoka (JP); Takashi Kuwata, Shizuoka (JP); Kenichiro Isobe, Shizuoka (JP); Masayoshi Fukatsu, Shizuoka (JP); Hironobu Ata, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/366,550

(22) Filed: Feb. 14, 2003

(65) Prior Publication Data

US 2003/0155705 A1 Aug. 21, 2003

(30) Foreign Application Priority Data

Feb. 19, 2002 (JP) ..... 2002/041406
Feb. 19, 2002 (JP) ..... 2002/041407

(51) Int. Cl.[7] ..... B65H 39/02

(52) U.S. Cl. ..... 270/58.09; 270/58.08; 270/58.11; 399/410

(58) Field of Search ..... 270/58.08, 58.09, 270/58.11, 58.12; 399/410

(56) References Cited

U.S. PATENT DOCUMENTS 4,473,425 A * 9/1984 Baughman et al. ..... 156/356
6,231,039 B1 * 5/2001 Chung ..... 270/58.01
6,286,830 B1 9/2001 Kitahara et al. ..... 271/223
6,330,999 B2 * 12/2001 Coombs et al. ..... 270/58.18
6,352,253 B1 3/2002 Hayakawa et al. ..... 270/58.12
6,382,614 B1 * 5/2002 Fukatsu et al. ..... 270/58.11
6,422,553 B1 * 7/2002 Asao ..... 270/58.11
6,450,492 B1 * 9/2002 Coombs et al. ..... 270/58.08
6,450,934 B1 * 9/2002 Coombs ..... 493/383
6,581,922 B2 * 6/2003 Kuwata et al. ..... 270/58.11

* cited by examiner

*Primary Examiner*—Patrick Mackey
(74) *Attorney, Agent, or Firm*—Fitzpatrick, Cella, Harper & Scinto

(57) ABSTRACT

A sheet treating apparatus including the first intermediate stacking portion for hitting an edge of a sheet in a transport direction against a wall to align the sheet, a pair of delivery rollers for delivering the sheet from the first intermediate stacking portion, the second intermediate stacking portion for carrying-in and supporting the sheet downstream of the pair of delivery rollers in the transport direction and aligning edges of the sheet in a cross direction perpendicular to the transport direction, a sheet stacking portion located below the second intermediate stacking portion in the gravitational direction, and a full load detecting unit for detecting full load of sheets on the sheet stacking portion, in which the full load detecting unit contacts an upper surface of sheets on the sheet stacking portion with a full load detecting flag, which has a pivotal fulcrum in a higher position than that of the pair of delivery rollers to detect a height of the upper surface, and does not perform full load detection of sheets during a sheet treatment in the intermediate stacking portion.

12 Claims, 17 Drawing Sheets

SHEET TREATING APPARATUS AND IMAGE FORMING APPARATUS

BACKGROUND OF THE INVENTION

1. Field of the Invention

The present invention relates to a sheet treating apparatus for applying a treatment to a sheet and an image forming apparatus provided with the same. In particular, the present invention relates to a sheet treating apparatus which is capable of performing full load detection at low costs by effectively using full load detecting means for detecting full load with a flag in treating a sheet and an image forming apparatus provided with the same.

2. Related Background Art

Up to now, for example, in order to reduce time and labor required for treatments such as alignment and stitch with respect to a sheet such as a copy sheet having images formed thereon, some of image forming apparatuses such as a copying machine, a printer, and a facsimile machine, are each provided with a sheet treating apparatus adapted to take the sheets having images formed thereon into the apparatus one after another and apply treatments such as alignment and stitch to the sheets.

Here, such a sheet treating apparatus is an apparatus which is capable of performing a treatment in a plurality of modes such as a mode for simply delivering sheets to a sheet stacking portion and stacking the sheets thereon and a mode for delivering sheets to a sheet stacking portion and stacking the sheets thereon after applying alignment and stitch treatments to the sheets in an intermediate stacking portion or the like. These sheets are stacked on an identical stacking portion. The sheet treating apparatus often detects full load of sheets on the sheet stacking portion using a transmissive photosensor or the like.

However, in the case in which a transmissive photosensor is used for detecting full load of sheets on a sheet stacking portion as in the above-mentioned conventional example, there is a problem in that the transmissive photosensor is costly.

Thus, some of the conventional sheet treating apparatuses detect full load of sheets on a sheet stacking portion according to a full load detecting flag provided with a pivotal fulcrum above a pair of delivery rollers for delivering sheets to the sheet stacking portion. In such a sheet treating apparatus, cost reduction can be realized by using the full load detecting flag.

However, the full load detecting flag is arranged among a plurality of intermediate stacking portions for temporarily holding sheets in order to perform treatments such as alignment and stitch and is provided with the pivotal fulcrum above the pair of delivery rollers as described above. Therefore, unless the full load detecting flag is retracted from a sheet transport path to the intermediate stacking portion, the full load detecting flag is pushed up by a sheet when the sheet is delivered. The pushed-up full load detecting flag abuts against the intermediate stacking portion and cannot pivot, whereby sheet jam occurs. In addition, when the full load detecting flag is lifted once, the intermediate stacking portion is placed above the sheet stacking portion, and, for example, the full load detecting flag is lifted upward for a predetermined time by sheets at the time of sheet alignment. Thus, the full load detecting flag detects an alignment surface during the alignment to erroneously detect that the sheets are fully loaded.

SUMMARY OF THE INVENTION

Therefore, the present invention has been devised in view of such a present situation, and it is an object of the present invention to make it possible to detect full load at low costs by effectively using full load detecting means for detecting full load with a flag.

In order to attain the above-mentioned object, a representative structure of the present invention is a sheet treating apparatus for applying treatments to a sheet delivered from an image forming apparatus main body, which includes: a first intermediate stacking portion for hitting an edge of a sheet in a transport direction of the sheet against a wall to align the sheet; delivery means for delivering a sheet from the first intermediate stacking portion; a second intermediate stacking portion provided with a function for carrying-in and supporting a sheet downstream of the delivery means in the transport direction and aligning edges of the sheet in a cross direction perpendicular to the transport direction of the sheet; a sheet stacking portion located in a lower position in the gravitational direction of the second intermediate stacking portion; and full load detecting means for detecting full load of sheets on the sheet stacking portion, in which the full load detecting means is means for contact-detecting a height of an upper surface of sheets on the sheet stacking portion with a full load detecting flag, which has a pivotal fulcrum in a higher position than that of the delivery means, and does not perform full load detection of sheets at the time of a sheet treatment in the intermediate stacking portion.

According to the above-mentioned structure, since full load detection of sheets is not performed at the time of a sheet treatment in the intermediate stacking portion, it is possible to perform full load detection of sheets effectively using the low-cost full load detecting means with the full load detecting flag.

DESCRIPTION OF THE PREFERRED EMBODIMENTS

Preferred embodiments of the present invention will be hereinafter described in detail illustratively with reference to the accompanying drawings. Note that dimensions, materials, shapes and relative arrangements of structural components described in the following embodiments should be appropriately changed according to a structure of an apparatus to which the present invention is applied and various conditions, and are not meant to limit a scope of the present invention only to them unless specifically described otherwise.

(First Embodiment)

Figure 1:
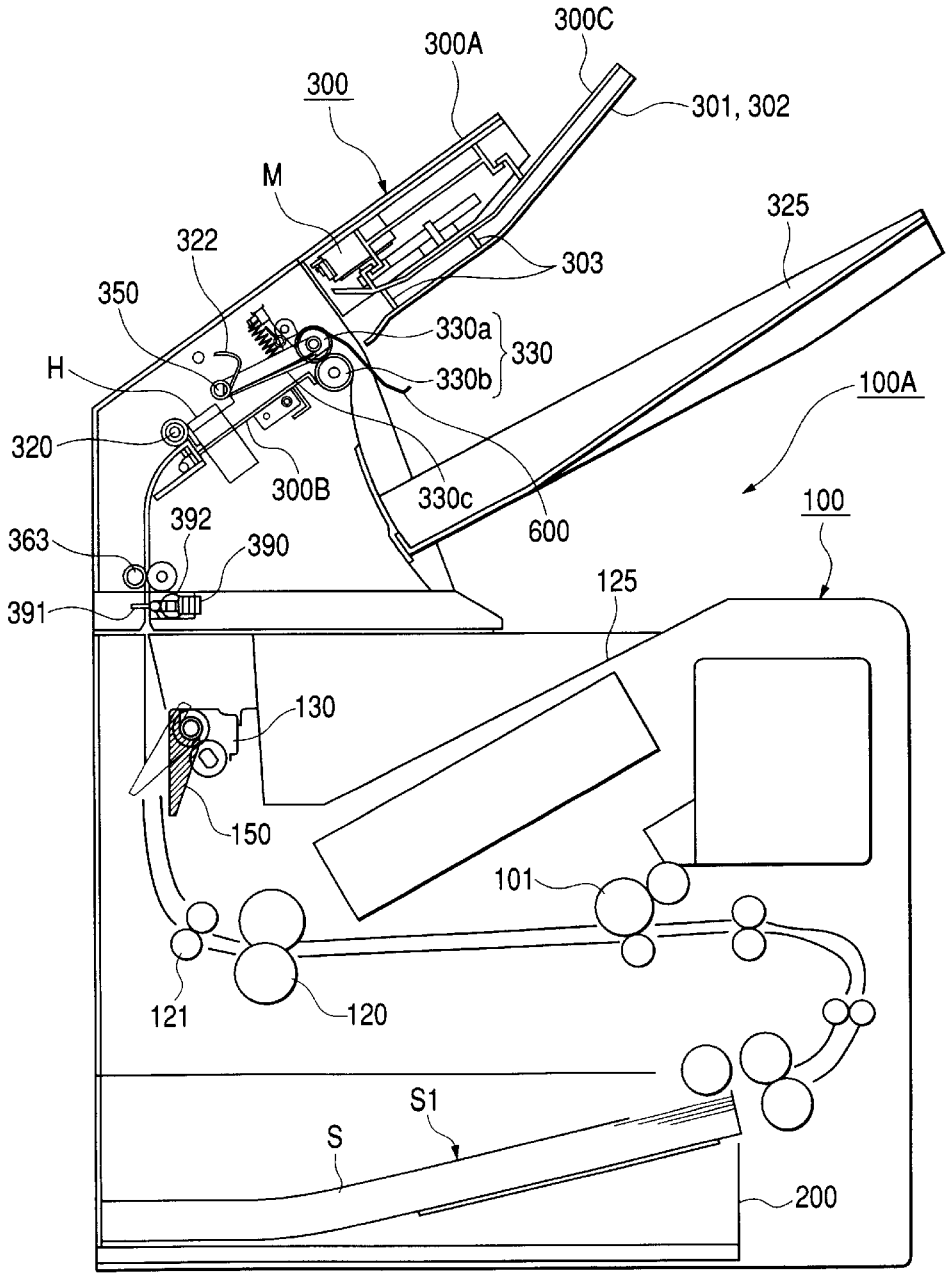
FIG. 1 is a schematic sectional view showing an overall structure of a laser beam printer, which is an example of an image forming apparatus provided with a sheet treating apparatus in accordance with a first embodiment of the present invention.
Figure 17:
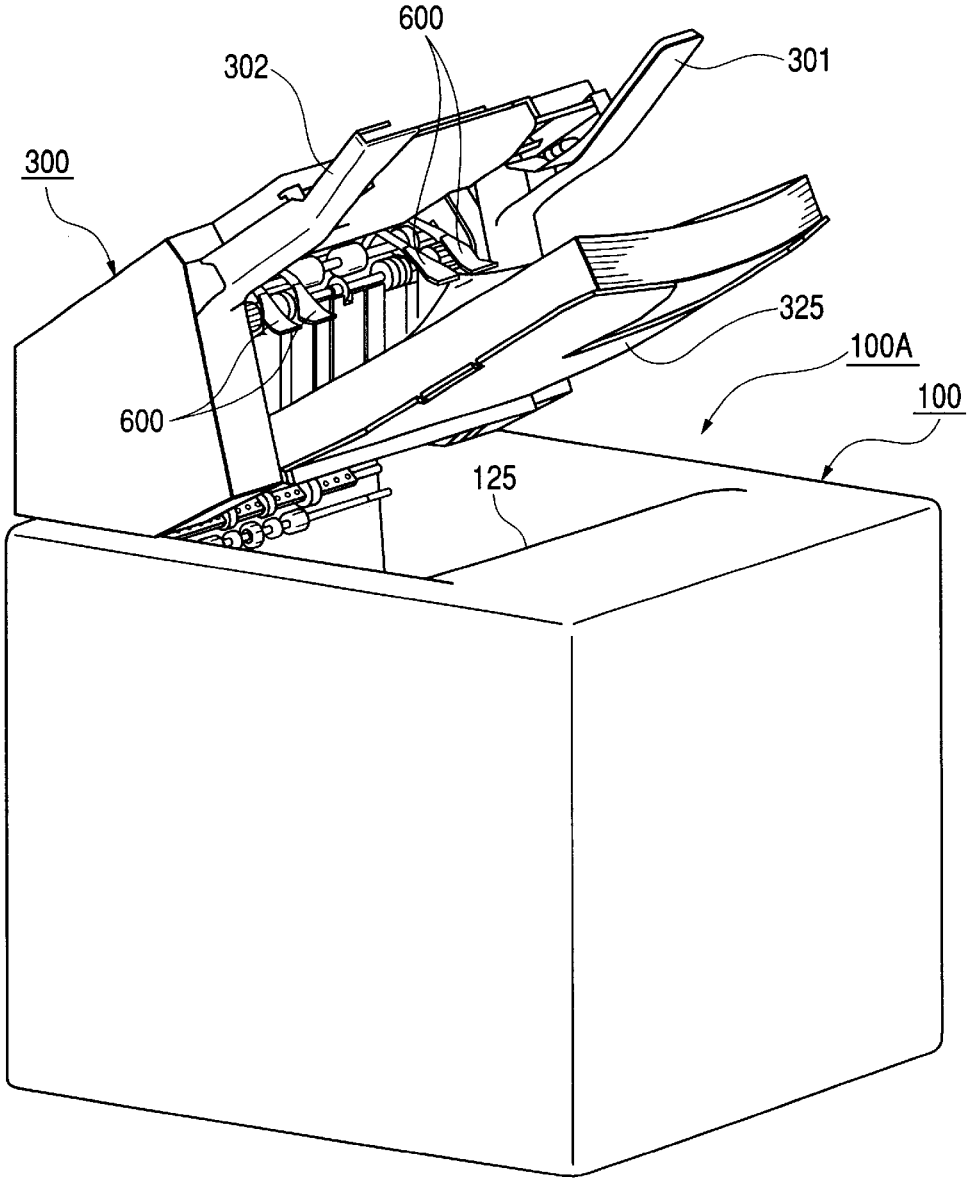
FIG. 17 is an overall perspective view of a laser beam printer, which is an example of an image forming apparatus provided with a sheet treating apparatus in accordance with the present invention.

FIG. 1 is a schematic sectional view showing an overall structure of a laser beam printer, which is an example of an image forming apparatus provided with a sheet treating apparatus in accordance with a first embodiment of the present invention. In addition, FIG. 17 is an overall perspective view of a laser beam printer, which is an example of an image forming apparatus provided with a sheet treating apparatus in accordance with the present invention.

(Overall Structure of the Image Forming Apparatus)

In FIG. 1, reference symbol 100A denotes a laser beam printer serving as an image forming apparatus and reference numeral 100 denotes a laser beam printer main body (hereinafter referred to as printer main body) serving as an image forming apparatus main body. The laser beam printer 100A is independently connected to a computer or a network such as an LAN, and forms an image (prints characters) on a sheet through a predetermined image forming process based on image information, a print signal, or the like sent from the computer or the network and delivers the sheet.

In addition, reference numeral 300 denotes a sheet treating apparatus. The sheet treating apparatus 300 is arranged above the printer main body 100. Also, the sheet treating apparatus 300 carries in and stacks sheets to be delivered to the outside from the printer main body 100 in a face down state, in which an image surface of a sheet faces downward, on a second intermediate stacking portion 300C (slide guides 301 and 302 discussed later) through a first intermediate stacking portion 300B via a transport portion in the sheet treating apparatus 300. Thereafter, the sheet treating apparatus 300 aligns the sheets using an alignment function of the second intermediate stacking portion 300C discussed later, bundles sheets for each predetermined job, and staples the sheets at one part or a plurality of parts thereof to deliver the sheets to a sheet stacking portion 325 and stack them thereon, or simply delivers the sheets to the sheet stacking portion 325 and stacks them thereon in the face down state.

Here, the sheet treating apparatus 300 and the printer main body 100 are electrically connected by a cable connector (not shown). In addition, the sheet treating apparatus 300 has a casing portion 300A for storing respective portions of the sheet treating apparatus 300 and is made detachably attachable to the printer main body 100.

(Structure of the Printer Main Body)

Next, a structure of the respective portions of the printer main body 100 will be described along a transport path of a sheet S to be transported.

In the printer main body 100, a plurality of sheets S are stacked on a feed cassette 200 and are separated and fed one by one from an upper most sheet S1 by means of various rollers. According to a predetermined print signal supplied from the computer or the network, first, a toner image is transferred onto an upper surface of the sheet S fed from the feed cassette 200 in an image forming portion 101 for forming a toner image by an image forming process of a so-called laser beam system. Then, heat and pressure are applied to the sheet S in a fixing device 120 on a downstream side of the transport path, so that this toner image is permanently fixed thereon.

Next, the sheet S having the image fixed thereon is turned over in a substantially U shaped sheet transport path reaching a delivery roller 130, as a result of which the image surface is reversed. The sheet S is delivered to the outside from the printer main body 100 in the face down state with the image surface facing downward in this way.

Here, it is selected, for example, whether the sheet S is delivered to a face down (FD) delivery portion 125 provided above the printer main body 100 or delivered to the sheet stacking portion 325 of the sheet treating apparatus 300 by the delivery roller 130 according to a position of a flapper 150 of the printer main body 100 which pivots in accordance with a control signal from a control portion (not shown).

(Structure of the Sheet Treating Apparatus)

Next, a structure of the sheet treating apparatus 300 and movements of respective portions of a printer in the case in which the sheet S transported from the printer main body 100 moves to the sheet treating apparatus 300 will be described with reference to FIGS. 2A and 2B and FIGS. 3A and 3B.

Figure 2A:
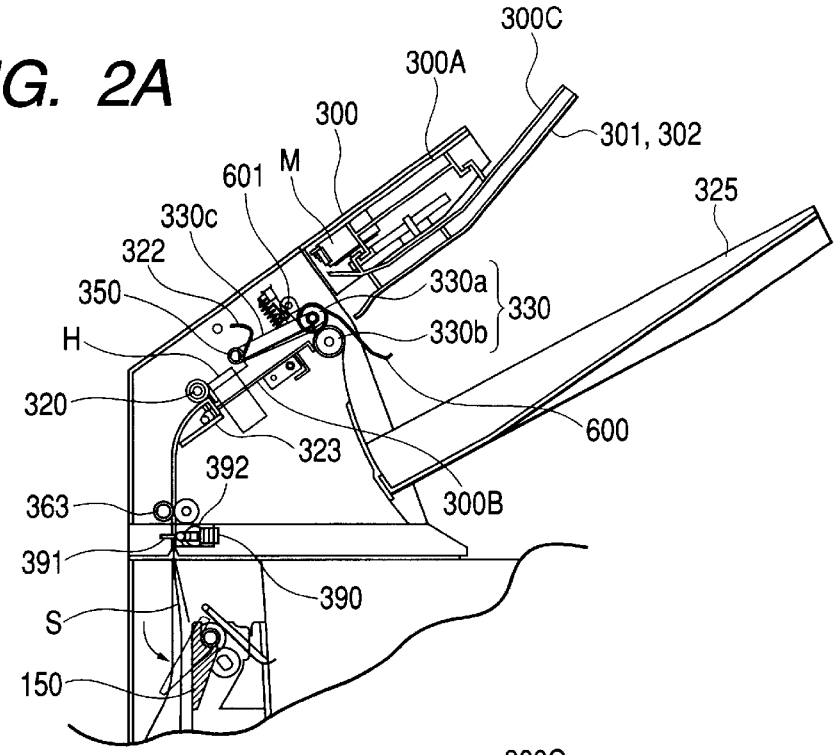
FIGS. 2A and 2B are views illustrating a structure of the sheet treating apparatus and movements of respective portions in the case in which a sheet transported from a printer main body moves toward the sheet treating apparatus.

In FIG. 2A, reference symbol 330*a* denotes a delivery upper roller; 330*b*, a delivery lower roller; M, a jogger motor serving as a drive source; 322, paddles; and 323, a reference wall against which a trailing edge (edge in a transport direction) of a sheet is hit. Here, as shown in FIG. 2A, a pair of delivery rollers 330 serving as delivery means constituted by the delivery upper roller 330*a* and the delivery lower roller 330*b* are arranged in an upper position on the downstream side in a sheet transport direction of the flapper 150 and are driven to rotate by a drive motor (not shown).

In addition, the delivery upper roller 330*a* is axially supported by an arm 330*c* pivotable around a paddle shaft 350. The jogger motor M (see FIG. 1) is a motor for driving the respective slide guides 301 and 302 discussed later. In this embodiment, a stepping motor is used as the jogger motor M.

In addition, the paddles 322, which are alignment means for aligning the edge of a sheet in the transport direction, consist of an elastic material such as rubber and are fixed to the paddle shaft 350 in a plural form in a direction perpendicular to the sheet transport direction. Then, when the sheet S is delivered from the printer main body 100, the paddles 322 rotate in the clockwise direction by the drive of the paddle shaft 350. Thus, the sheet S moves in an opposite direction of the sheet transport direction, and thereafter, the trailing edge (edge in the transport direction) thereof abuts against the reference wall 323 so that the sheet S is aligned. Note that an alignment property can be further increased by providing the paddles 322 in this way.

Figure 3A:
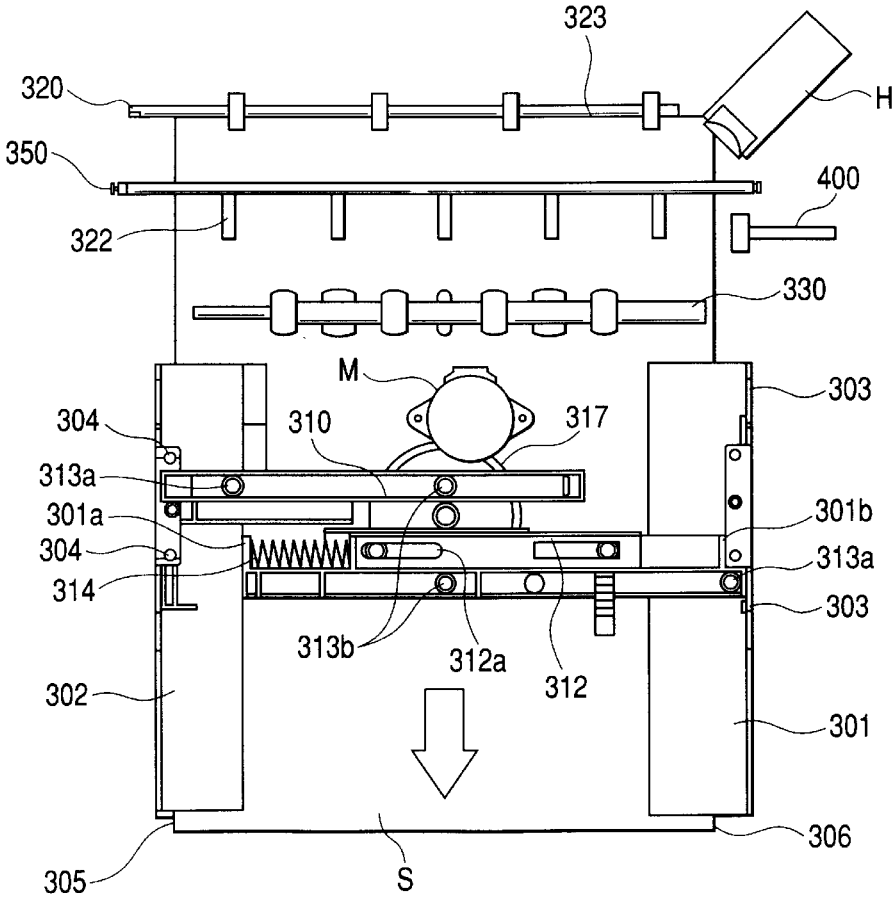
FIGS. 3A and 3B are a plan view and a side view of the substantial part of the sheet treating apparatus, respectively.
Figure 3B:
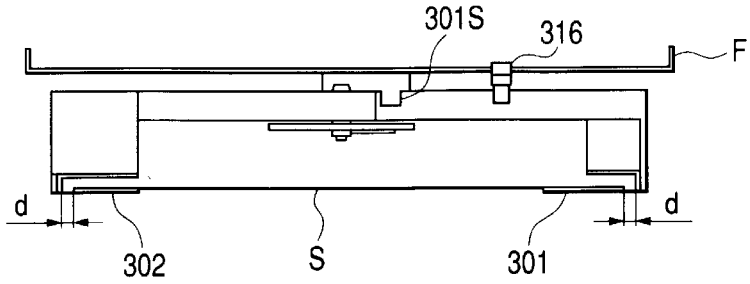

In addition, as shown in FIGS. 3A and 3B, in the sheet treating apparatus 300 of this embodiment, the slide guides 301 and 302, details of which will be described later, are provided as the second intermediate stacking portion 300C (alignment means) provided with a function for performing alignment in a cross direction perpendicular to the sheet transport direction.

Moreover, in FIG. 3A, reference symbol H denotes a stapler serving as stitch means for applying a stitch treatment to a sheet stack by driving a staple into the sheet stack. In this embodiment, the stapler H is arranged to be fixed on the slide guide 301 side in order to stitch respective sheets by driving a staple in an upper left corner part on an image surface of a sheet on which an image is formed.

Further, the sheet treating apparatus 300 with such a structure is adapted to perform the staple treatment based on a command outputted from the computer or the like in advance. In the case in which the sheet treating apparatus 300 performs such a staple treatment, the flapper 150 is pivoted in the counter clockwise direction as shown in FIG. 2A by a solenoid (not shown) before the sheet S to be stapled is delivered by a transport roller 121 (see FIG. 1) provided in the printer main body 100, and a delivery path is switched to the sheet treating apparatus side.

Consequently, the sheet S is carried into the sheet treating apparatus 300 by the transport roller 121. Then, the sheet S carried into the sheet treating apparatus 300 rotates a flag 391 of an entrance sensor 390 in the clockwise direction, and thus is detected as the flag 391 transmits light through a photosensor 392. Thereafter, the sheet S is transported upward by a pair of entrance rollers 363.

(Delivery and Stacking Operation)

Incidentally, in this embodiment, the sheet treating apparatus 300 is capable of stapling sheets to deliver the sheets to the sheet stacking portion 325 and stack them thereon or simply delivering the sheets to the sheet stacking portion and stacking them thereon in the face down state. The respective delivery and stacking operations will be hereinafter described.

(Face Down Delivery and Stacking)

First, the operation for delivering sheets to the sheet stacking portion 325 and stacking them thereon in the face down state will be described.

Figure 4A:
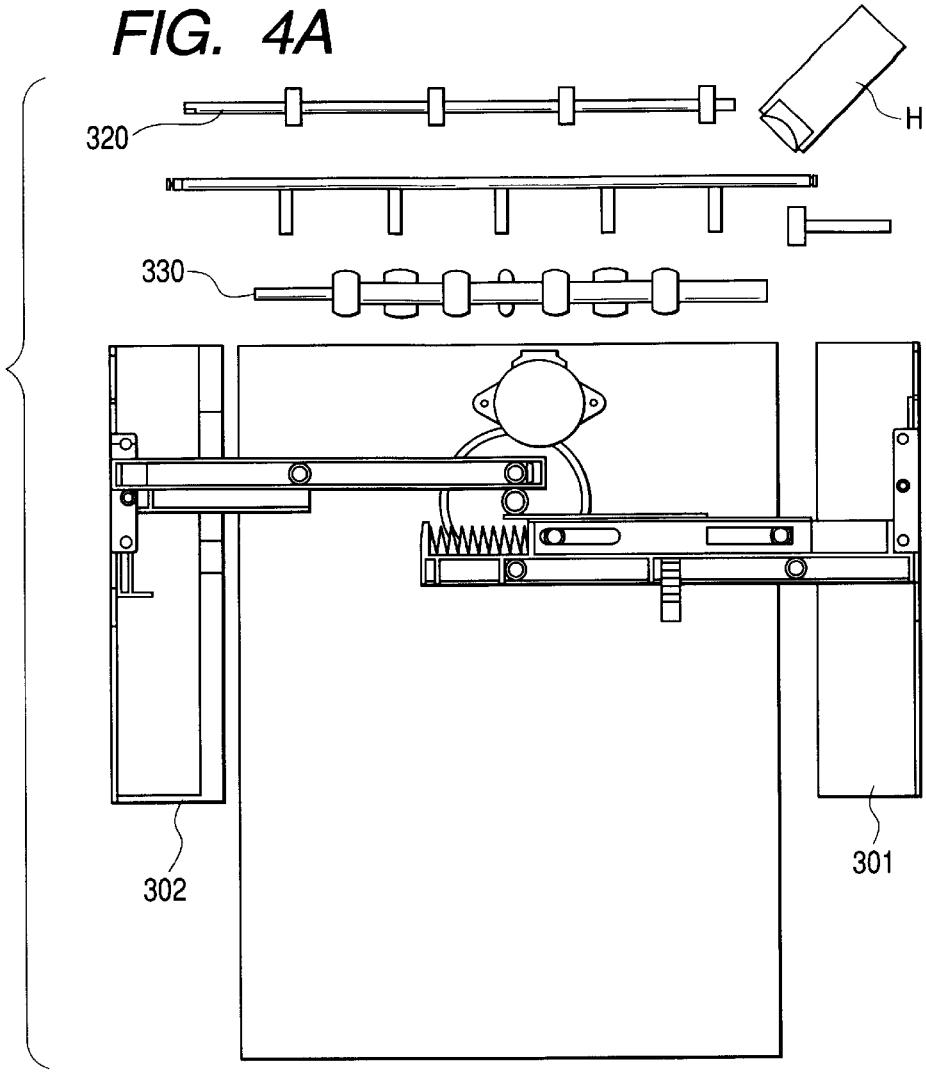
FIGS. 4A and 4B are views showing a state in which a slide guide provided in the sheet treating apparatus is placed in a home position and a sheet stack falls.

In this case, as shown in FIG. 4A, bottom surfaces of the slide guide 301 on a right side and the slide guide 302 on a left side with respect to a sheet carrying-in direction retract to positions where the bottoms surfaces do not abut against the sheet S to be carried in, that is, positions which are outside in a cross direction of the sheet S by a predetermined amount.

Figure 2B:
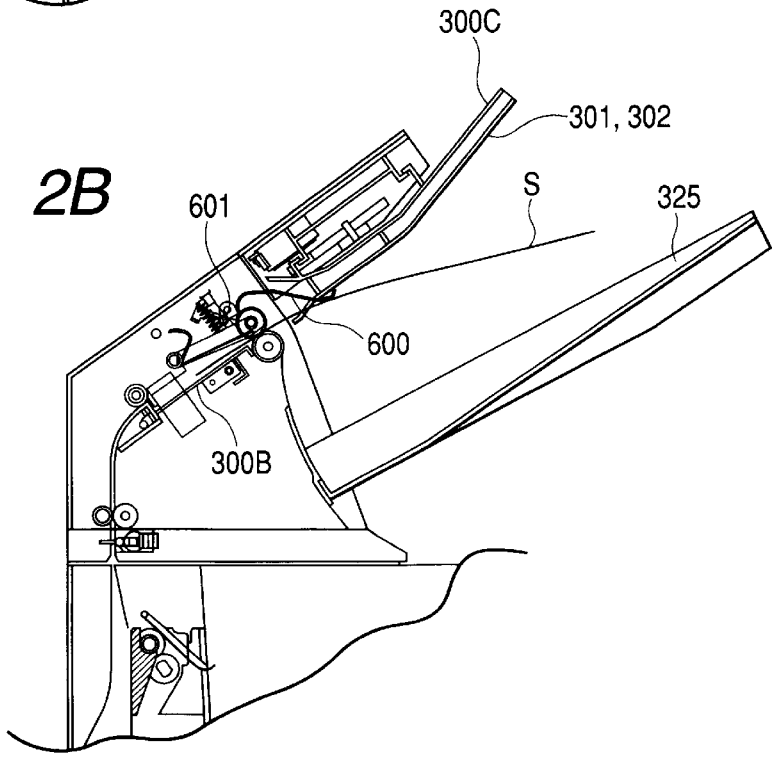
Figure 4B:
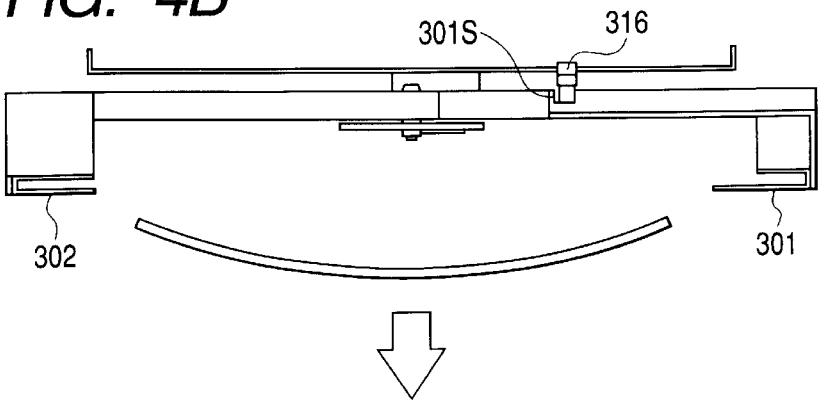

Therefore, after passing through a pair of staple rollers 320, the sheet transported by the pair of entrance rollers 363 passes the front of the stapler H, and then, is transported by the pair of delivery rollers 330, and falls toward the sheet stacking portion 325 as indicated by an arrow of FIG. 4B and as shown in FIG. 2B. In this case, a full load detecting flag 600 of FIG. 2A is pushed up by the sheet S around a pivotal center 601 and rotates as shown in FIG. 2B.

(Delivery and Stacking after Stapling)

Next, the operation for stapling sheets and delivering the sheets to the sheet stacking portion 325 and stacking them thereon will be described.

Figure 9:
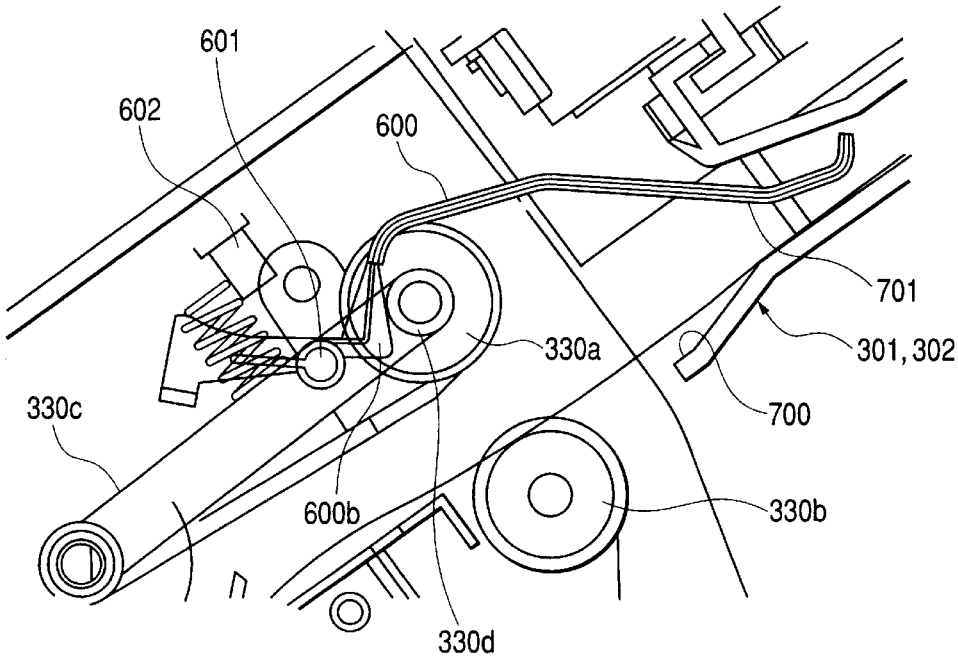
FIG. 9 is a partially enlarged view of FIG. 5B illustrating a full load detecting flag provided in the sheet treating apparatus in accordance with the first embodiment.

Here, as shown in FIG. 4A, the slide guides 301 and 302 move from the positions where the bottom surfaces of the slide guide 301 on the right side and the slide guide 302 on the left side with respect to the sheet carrying-in direction do not abut against the sheet S to be carried in, that is, the positions which are outside in the cross direction of the sheet S by a predetermined amount to positions where reference pins 303 and 304 provided on wall surfaces of the slide guides 301 and 302 do not interfere with the sheet S to be carried in as shown in FIG. 3A, that is, positions which are outside in the cross direction of the sheet S by a predetermined amount or more. Before this movement, as shown in FIG. 9, the full load detecting flag 600 pivots the arm 330*c*, which is used as drive means of the full load detecting flag 600, in the upward direction. A cum surface 600*b* of the full load detecting flag 600 is pushed up by a cum surface 330*d* of the arm 330*c*, so that the full load detecting flag 600 retracts to a position shown in FIG. 9 which is a second position where it does not interfere with the slide guides 301 and 302. In this state, the slide guides 301 and 302 are moved to the state of FIG. 4A, the full load detecting flag 600 is inserted in the slide guides 301 and 302, and the arm 330*c* is lowered to a position where the pair of delivery rollers 330 nip the sheet S again to prepare for carrying in the sheet S. This is an initial operation at the time of staple stack.

In addition, at this point, the two slide guides 301 and 302 are in positions where a space between end faces of the bottom surfaces thereof is smaller than the width of the sheet S. Since the two slide guides 301 and 302 are in such positions (first positions), the second intermediate stacking portion 300C can be constituted so as to support the entering sheet S.

Therefore, after passing through the pair of staple rollers 320, the sheet S transported by the pair of entrance rollers 363 passes the front of the stapler H, and then, is transported by the pair of delivery rollers 330 onto a guide surface of the second intermediate stacking portion 300C constituted by the slide guides 301 and 302.

Note that, although the arm 33*c* is used as the drive means of the full load detecting sensor in this embodiment, the sheet treating apparatus of the present invention is not limited to this but may have a structure in which dedicated drive means is provided separately, for example.

Figure 5A:
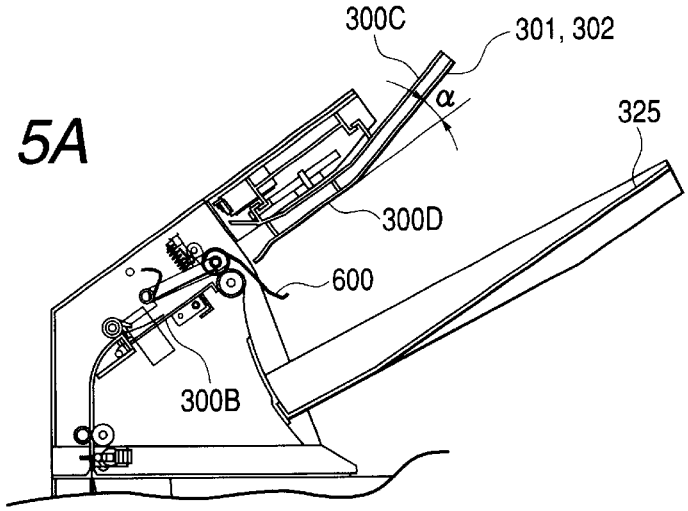
FIGS. 5A, 5B and 5C are views illustrating movements of the respective portions in a treatment operation of the sheet treating apparatus.

Here, as shown in FIG. 5A, the guide surface of the second intermediate stacking portion 300C is inclined at a predetermined angle with respect to the horizontal direction, and at the same time, has angles of inclination which are different from each other on an upstream side and a downstream side of the sheet carrying-in direction. More specifically, a bent portion 300D is formed which is bent at an angle of inclination a between a predetermined section on the upstream side and a predetermined section on the downstream side. Note that, since the second intermediate stacking portion 300C has such a bent portion 300D, there is prevented deflection in a central part of the sheet S which is not guided by the respective slide guides 301 and 302 forming the second intermediate stacking portion 300C.

Figure 5B:
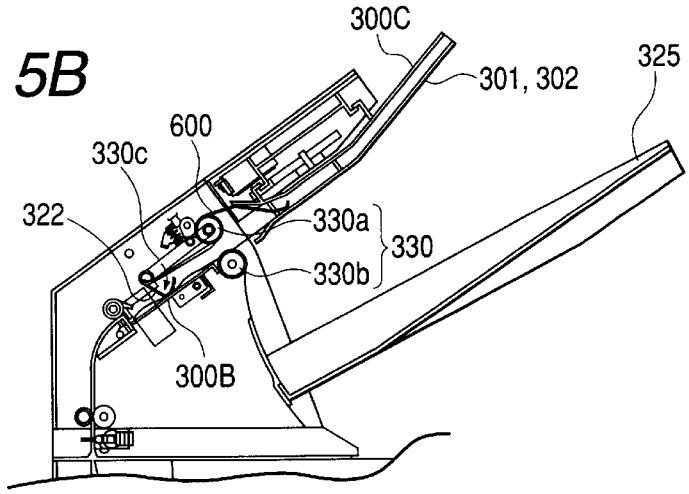

On the other hand, immediately after a first sheet is transported onto the surface formed by the slide guides 301 and 302, as shown in FIG. 5B, the arm 330*c* pivots in the counter clockwise direction. Thus, the delivery upper roller 330*a* axially supported by the arm 330*c* retracts to the upward direction and the pair of delivery rollers 330 are spaced apart from each other.

In this case, as shown in FIG. 9, the full load detecting flag 600 is brought into a state in which it is lifted in the slide guides 301 and 302 by the cum surface 330*d* of the arm 330*c* around the pivotal center 601.

Simultaneously with this, the drive connected to the pair of delivery rollers 330 is disconnected, and the rotation of the delivery upper roller 330*a* and the delivery lower roller 330*b* is stopped. As a result, when the trailing edge of the sheet S passes the pair of staple rollers 320 completely, the sheet S returns to the opposite direction of the transport direction with the aid of the gravitational force of the sheet and moves in a direction of the reference wall 323.

(Alignment Operation in a Cross Direction of a Sheet)

Next, only the slide guide 302 on the left side operates, and an alignment operation of a cross direction of the sheet S stacked on the first intermediate stacking portion 300B and the second intermediate stacking portion 300C is started. More specifically, the slide guide 302 is driven by the jogger motor M to move to the right side of FIGS. 3A and 3B, so that the reference pin 304 provided in the slide guide 302 abuts against a left side of the sheet S to push the sheet S to the slide guide 301 side.

Figure 6A:
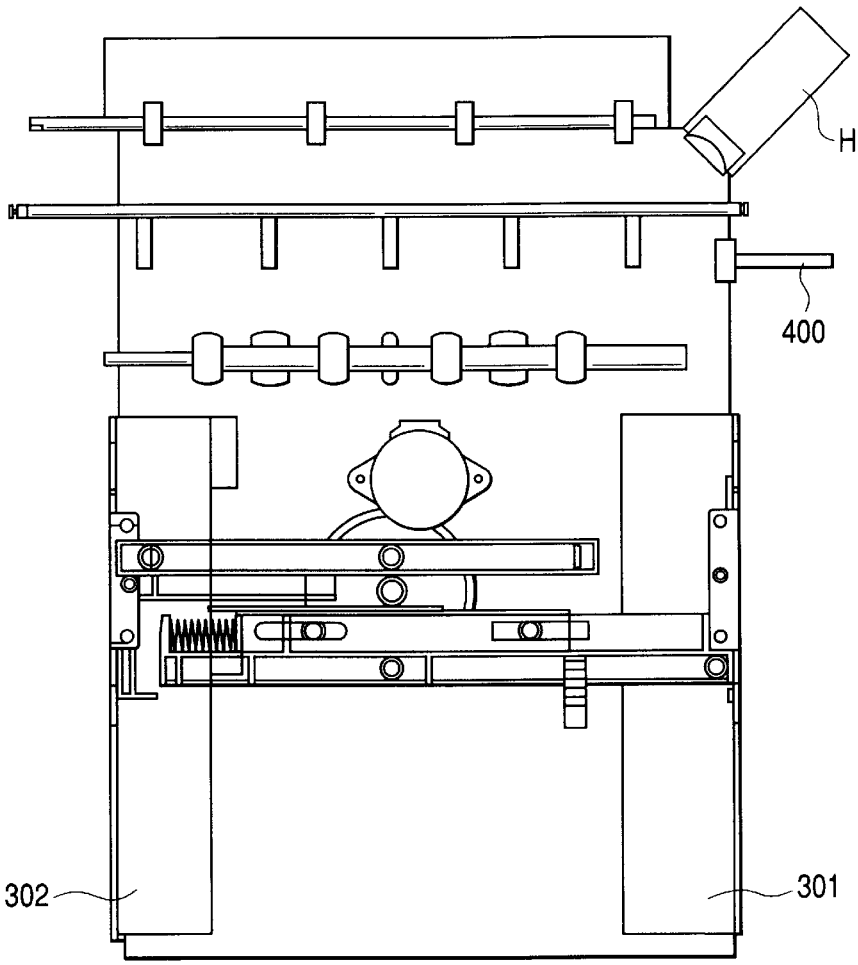
FIGS. 6A and 6B are views showing a state in which a sheet is aligned by the slide guide.
Figure 6B:
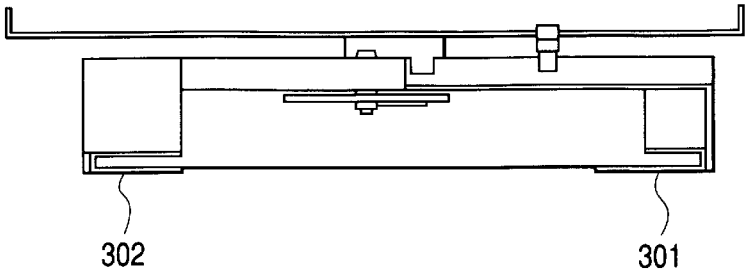

Then, a right side of the sheet S abuts against the reference pin 303 provided in the slide guide 301, so that the slide guide 302 moves to a position shown in FIGS. 6A and 6B and alignment in the cross direction of the sheet S is performed. In the position where the sheet S abuts against the reference pin 303 to be aligned, the sheet S is set to move to a set staple position. After the alignment operation, the slide guide 302 moves in a direction in which it becomes wider than the width of the sheet S, thereby preparing for coping with the transport of the next sheet in a standby position again.

(Structure of the Slide Guides)

Here, a structure of the slide guides 301 and 302 will be described in detail.

The respective slide guides 301 and 302 are guided by four guide pins in total, which consists of guide pins 313*a* provided in mold frames F as shown in FIG. 3B and guide pins 313*b* provided in sheet metal frames F' (not shown), thereby being made reciprocally movable in a horizontal direction in FIGS. 3A and 3B, that is, in a direction (cross direction) perpendicular to the sheet transport direction, and at the same time, moved by a drive force from the jogger motor M.

In addition, as shown in FIG. 3B, when viewed from the downstream side in the sheet transport direction, the respective slide guides 301 and 302 are shaped in a substantially "C"-shape in cross section by respective wall portions guiding both the sides of the sheet S and support portions supporting the top and bottom surfaces of the sheet S. The slide guides 301 and 302 are constituted so as to support each sheet, which is delivered onto the first intermediate stacking portion 300B and transported to the second intermediate stacking portion 300C, by the lower surface of this "C"-shape, and not to guide the central part in the cross direction of the sheet S.

Moreover, a slide rack portion 310 that has a spur rack mating with a step gear 317 is provided in the slide guide 302. In addition, a slide rack 312 that has a spur rack mating with the step gear 317 is also provided in the slide guide 301.

Here, the slide rack 312 is provided so as to be movable relatively to the slide guide 301 via a coil-like spring 314. Note that this spring 314 abuts against the slide guide 301 on one end side thereof and abuts against the slide rack 312 on the other end side thereof, and biases the slide guide 301 and the slide rack 312 in a direction in which a space between them is widened. In addition, the slide rack 312 has a square hole portion 312*a* for moving an emboss portion 301*a* on the slide guide 301 side.

Moreover, the two reference pins 303 consisting of a metal excellent in abrasion resistance are provided on the side wall of the slide guide 301 and the two reference pins 304 are provided on the side wall of the slide guide 302. When a sheet is aligned, the slide guide 302 moves as described above, and the reference pins 304 and 303 abut against the opposed side edges 305 and 306 of the sheet, respectively.

In addition, the slide guide 301 and the slide guide 302 are supported by the step gear 317 and the jog sheet metal frames F' (not shown) in a height direction thereof.

(Operation of the Slide Guides)

Next, operations of the respective slide guides 301 and 302 will be described.

When the sheet treating apparatus 300 is turned on, the pair of staple rollers 320 starts rotation, and then, the rotation of the jogger motor M rotates the step gear 317, whereby the rack portion 310 of the slide guide 302 is driven to retract to the outside.

In addition, when the rotation of the jogger motor M rotates the step gear 317, after the slide rack 312 relatively moves first and the square hole portion 312*a* of the slide rack 312 abuts against a left end of the emboss portion 301*a* of the slide guide 301 in FIG. 3A, the slide guide 301 retracts to the outside by being pressed by the square hole portion 312*a*.

A slit portion 301S is provided in the slide guide 301. When the slit portion 301S moves to a predetermined retraction distance, as shown in FIG. 4B, light is transmitted through the photosensor 316, and the jogger motor M stops at this point. This position is hereinafter referred to as a home position.

On the other hand, when a signal to the effect that the sheet S is entering the sheet treating apparatus 300 is inputted from the printer main body 100, the jogger motor M rotates, and the slide guides 301 and 302 move to the inside and stop in a position where the space between the slide guides 301 and 302 is wider than the width of the entering sheet S by a predetermined amount "d" as shown in FIG. 3B. In this position, a stopper 301*b* abuts against the guide pins 313*a* to bring the slide guide 301 into a state in which it cannot move to the inside further. This position is hereinafter referred to as a standby position. Note that, in this standby position, the side of the slide guide 301 becomes a reference position at the time of the alignment operation.

Here, in this embodiment, the standby positions of the slide guides 301 and 302 are set such that gaps on both sides thereof are equal to or larger than the predetermined amount "d," respectively, in the case in which the size (width) of the sheet S is a passable maximum size.

Note that if a sheet having a width narrower than this is aligned, the slide guide 302 moves to the right by an amount corresponding to the width, whereby the gap on the left side in the standby position shown in FIGS. 3A and 3B is always the predetermined amount "d." On the other hand, in this case, a gap between the sheet and the slide guide 301 is widened by a half of the amount reduced from the predetermined amount "d."

On the other hand, after the slide guides 301 and 302 perform alignment in the cross direction as shown in FIGS.

6A and 6B, both the slide guides 301 and 302 retract to the outside by a slight amount, whereby regulation of an alignment direction of the sheet S is eased to bring the sheet S into a state in which it is movable in the sheet transport direction. Thereafter, as shown in FIG. 5B, the paddles 322 rotate once in the clockwise direction around the paddle shaft 350 while abutting against the upper surface of the sheet S, whereby the sheet S is hit against the reference wall 323 to be aligned.

Figure 7A:
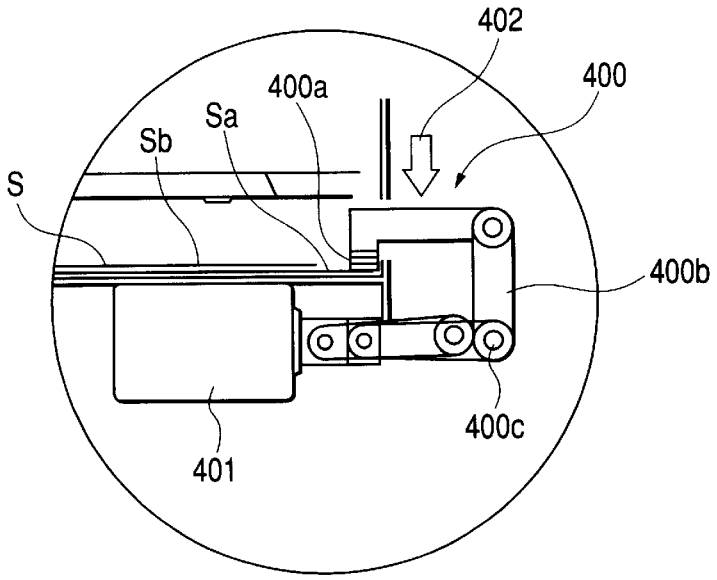
FIGS. 7A and 7B are views illustrating a structure of stamp means provided in the sheet treating apparatus.
Figure 7B:
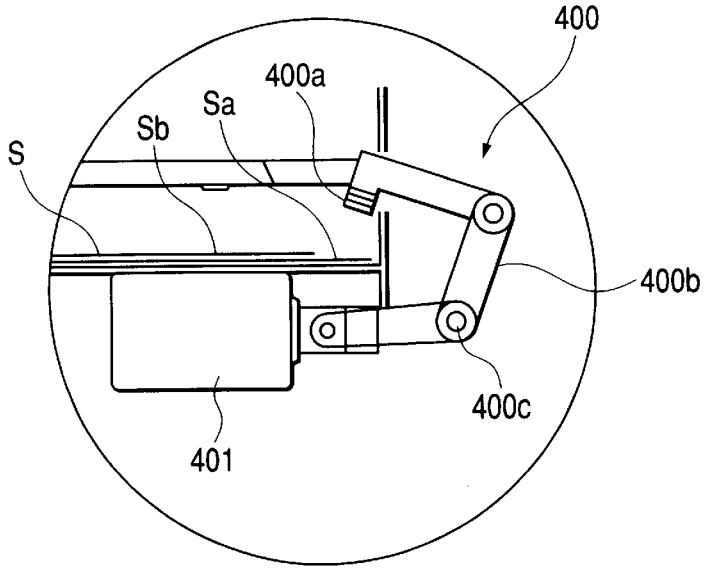

Then, it becomes possible to align the sheet S in the sheet transport direction and the cross direction through these operations. Note that, in order to keep the aligned state of the sheet S, stamp means 400 for pressing the aligned sheet S as a lever 400*b*, which is provided with a frictional member 400*a* as shown in FIGS. 7A and 7B discussed later, moves in the vertical direction is provided in the vicinity of the right edge of the sheet S in the aligned state as shown in FIG. 6A.

Then, after the alignment operation is finished, the upper surface of the sheet S is pressed by the stamp means 400 before a next sheet entering the sheet treating apparatus 300 abuts against the aligned sheet S, whereby the sheet S in the aligned state is prevented from moving by the next sheet to break the alignment.

Note that, after the alignment of the first sheet is finished in this way, a second sheet is transported. In this case, at the time of transport of each of the second and subsequent sheets, since the pair of delivery rollers 330 are spaced apart from each other, when a trailing edge of the sheet passes the pair of staple rollers 320 completely, the sheet returns to the opposite direction of the transport direction with the aid of the gravitational force of the sheet and moves in the direction of the reference wall 323. Note that, since the alignment operation from this point is completely the same as that for the first sheet, a description of the alignment operation will be omitted.

Then, such operations are performed repeatedly, an operation for aligning a last (nth) sheet (Sn) of one job is performed, each reference pin 304 provided in the slide guide 302 hits a left side edge of the sheet against each reference pin 303 of the slide guide 301, and a position on a right side of a trailing edge of the sheet is stapled with a small stapler H, which is located on a right side in a trailing edge of a sheet stack in the state of FIG. 6A in which movement of the slide guide 302 is stopped.

Here, according to this structure and operation, since the slide guide 301 stops and does not move in the reference position during the alignment operation of each sheet and only the slide guide 302 moves to align an end on a left side of each sheet with the reference position, the stitch treatment by the stapler H fixedly arranged on the slide guide 301 side is performed accurately and surely.

Moreover, even in the case in which a width of each sheet carried in during one job varies or the case in which a sheet size is changed, for example, from LTR to A4 during one job, since a position of a left end of each sheet is aligned, an excellent effect is obtained in that finish of the stitch treatment by the stapler H is accurate and tidy.

Figure 5C:
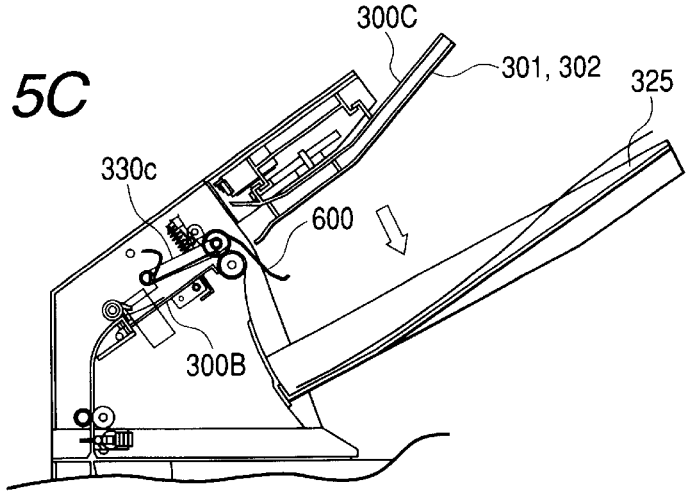

On the other hand, when the staple operation ends in this way, as shown in FIG. 5C, the arm 330*c* rotates in the clockwise direction, whereby the delivery upper roller 330*a* axially supported by the arm 330*c* moves downward to form the pair of delivery rollers 330, and at the same time, the pair of delivery rollers 330 are driven to start rotation of the delivery upper roller 330*a* and the delivery lower roller 330*b*. Consequently, a sheet stack S is nipped by the pair of delivery rollers 330 to be transported onto the second intermediate stacking portion 300C formed by the slide guides 301 and 302.

Thereafter, when the sheet stack S is delivered from the pair of delivery rollers 330 completely, the jogger motor M is driven to rotate, whereby the slide guide 302 moves in a direction in which it spreads from the state shown in FIG. 6A. Note that, at the time when the slide guide 302 starts to move, on the slide guide 301 side, the slide rack 312 moves to the right side of FIG. 6A and the slide guide 301 itself does not move immediately.

Then, when the position of the slide guide 302 passes the standby position shown in FIG. 3A, the square hole portion 312*a* of the slide rack 312 abuts against the end face of the emboss portion 301*a* of the slide guide 301, the slide guide 301 starts movement to the right side of FIG. 3A, and both the slide guides 301 and 302 move.

Moreover, thereafter, when the space between both the slide guides 301 and 302 becomes close to or wider than a width of a sheet, the stapled sheet stack supported by the slide guides 301 and 302 falls as shown in FIG. 5C and is stacked on the sheet stacking portion 325. These are the structures and the series of operations of the printer main body and the sheet treating apparatus in this embodiment.

Incidentally, as described above, in this embodiment, the sheet treating apparatus 300 is mounted above the printer main body 100 and a transport path of a sheet delivered from the printer main body 100 is switched by the flapper 150, whereby the sheet can be reversed to be delivered and stacked.

Here, since the sheet treating apparatus 300 is mounted above the printer main body 100 and a sheet is reversed to be delivered and stacked in this way, sheets on which images are formed can be delivered and stacked in an order of pages without providing a switchback mechanism. In addition, an inconvenience in that a sheet interval must be widened for switchback is eliminated.

In this way, in the printer main body 100 for delivering a sheet to an upper surface of the printer, the sheet treating apparatus 300 is provided above the delivery portion on the upper surface of the printer main body 100, and in a state in which the sheet is reversed or after the treatment is applied to the sheet in the reversed state, an operation for delivering the sheet to the sheet stacking portion 325 is performed selectively. Consequently, the structure of the sheet treating apparatus 300 can be simplified, and at the same time, an area and costs for installation of the sheet treating apparatus 300 and the printer main body 100 provided with the same can be reduced.

Note that, in the above descriptions, only the slide guide 302 operates at the time of the alignment operation of a sheet and the slide guide 301 does not move. However, the slide guide 301 may also operate at the time of the alignment operation of a sheet. This can be realized, for example, by adopting the same structure as the slide guide 302 in the slide guide 301.

Moreover, in the case in which a sheet after the alignment operation is fallen, the two slide guides 301 and 302 operate in the above descriptions. However, only one of them may operate when the sheet S is fallen.

In addition, in the above descriptions, the case in which the stitch treatment is performed as a treatment for a sheet has been described. However, according to this structure, it becomes possible to obtain the same effect with a sheet treating apparatus, which performs a treatment for making a sheet stack by using a puncher for cutting holes in a sheet or pasting sheets together.

Incidentally, FIGS. 7A and 7B are views showing a structure of the stamp means 400 described above which serves as misalignment prevention means. As shown in FIGS. 7A and 7B, the stamp means 400 is provided with the frictional member 400*a* at its tip, and at the same time, provided with the arm lever 400*b* serving as a pressing member which can pivot with the shaft 400*c* as a fulcrum, a solenoid 401 serving as releasing means for pivoting the arm lever 400*b* to release a pressing operation of the arm lever 400*b*, and a torsion coil spring which biases the arm lever 400*b* in a direction indicated by the arrow 402, that is, a direction in which the arm lever 400*b* presses a sheet S to a direction of the slide guide 301.

Here, when the delivery operation is performed, as shown in FIG. 7A, the arm lever 400*b* of the stamp means 400 presses an aligned preceding sheet Sa in a position outside a sheet transport path on which a succeeding sheet Sb passes, that is, outside a sheet pass area with a force of the torsion coil spring.

Consequently, it is possible to prevent the arm lever 400*b* from abutting against the succeeding sheet Sb to be delivered next, and at the same time, prevent the preceding sheet Sa which is already held on the second intermediate stacking portion 300C in an aligned state from being pushed out by the succeeding sheet Sb.

Figure 8A:
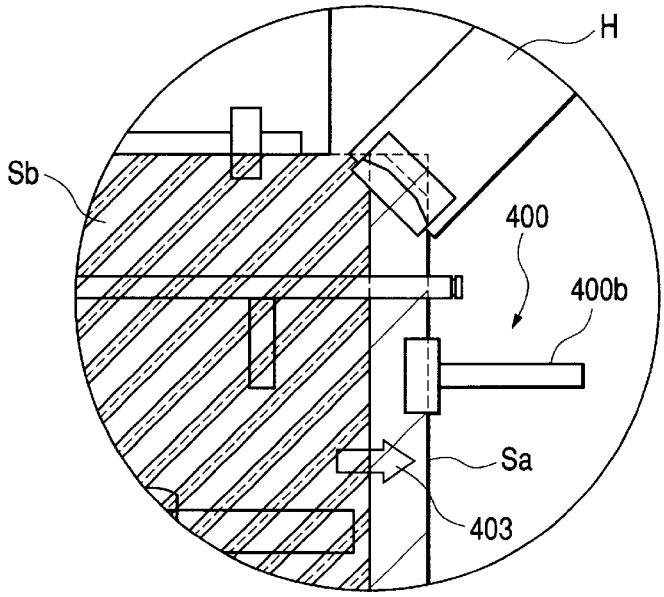
FIGS. 8A and 8B are views illustrating a state at the time of sheet alignment of the stamp means.
Figure 8B:
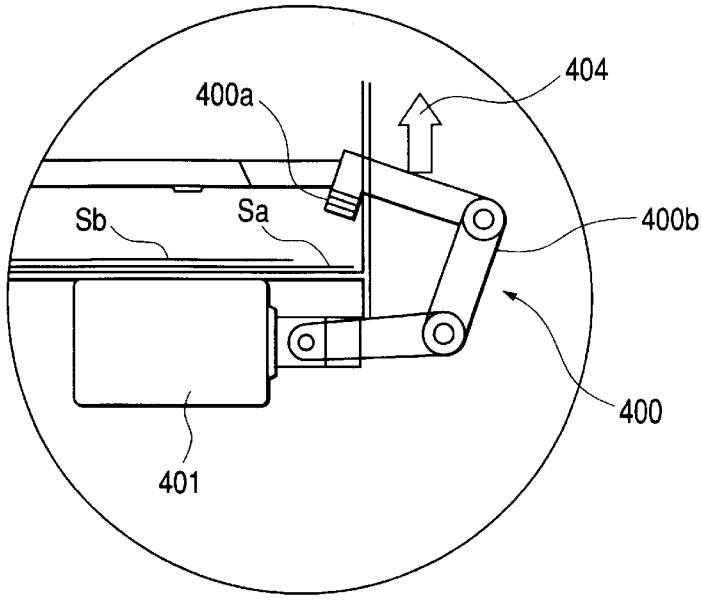

On the other hand, when the succeeding sheet Sb is delivered completely, the succeeding sheet Sb moves in a direction indicated by the arrow 403 shown in FIG. 8A in accordance with the movement of the slide guide 302 already described. Then, while the succeeding sheet Sb is moving in this way, the solenoid 401 is turned on. Consequently, the arm lever 400*b* pivots in a direction indicated by the arrow 404 shown in FIG. 8B, and as a result, the succeeding sheet Sb slips into a portion under the arm lever 400*b*.

Note that, thereafter, after the alignment in the sheet transport direction by the paddles 322 is performed, the slide guide 302 returns to the standby position. In this embodiment, the solenoid 401 is turned off before the slide guide 302 returns to the standby position and a preparation for carrying in the succeeding sheet Sb is completed. Consequently, the arm lever 400*b* presses the preceding sheet Sa again. As a result, the preceding sheet Sa can be prevented from being pushed out by the succeeding sheet Sb to be transported thereafter.

(Full Load Detection by the Full Load Detecting Flag)

Next, movements of the full load detecting flag will be described.

As shown in FIG. 9 (partially enlarged view of FIG. 5B), when the full load detecting flag 600 is lifted by the arm 330*c* serving as drive means, a photosensor 602 shifts form a light shielding state to a light transmission state. If the sheet treating apparatus 300 detects this state as full load of sheets, false detection of full load of sheets occurs. Thus, in this embodiment, the full load detecting flag 600 is prevented from checking full load of sheets in terms of software in the case in which the full load detecting flag 600 is within the slide guides 301 and 302 (in a position where the full load detecting flag 600 does not interfere with the slide guides 301 and 302) (second position), that is, at the time of sheet stack on the second intermediate stacking portion 300C. Then, when a sheet is delivered, after the arm 330*c* is lowered (first position) by a stepping motor (not shown) and a sheet stack is delivered, the full load detecting flag 600 checks full load of sheets at predetermined timing. Upon detecting that the full load detecting flag 600 transmits light through the photosensor 602 for a predetermined time or more in that position, the sheet treating apparatus 300 detects it as full load of sheets on the sheet stacking portion 325.

However, in the case of sheet stack in which the slide guides 301 and 302 are simply retracted to the position of FIG. 4A, the full load detecting flag 600 is always in a lowered state (first position for detecting full load of sheets), and always checks full load on the sheet stacking portion 325. Then, while a sheet of a maximum length to be delivered is pushing up the full load detecting flag 600 during the delivery, the full load detecting flag 600 is in a transmission state, and the sheet treating apparatus 300 detects full load. In the case in which it is confirmed that the full load detecting flag 600 transmits light through the photosensor 602 at least throughout a time equal to or longer than a time during which the sheet is pushing up the full load detecting flag 600 during the delivery, the sheet treating apparatus 300 detects it as full load and ends the stacking.

As described above, according to this embodiment, at the time of alignment and stack treatments, the full load detecting flag 600 is moved to the second position to prevent the slide guides 301 and 302 and the full load detecting flag 600 from interfering with each other, and the full load detecting flag 600 is constituted so as not to check full load when it is in the second position, whereby it becomes possible to perform full load detection of sheets with a low-cost full load detecting flag.

(Second Embodiment)

Figure 10A:
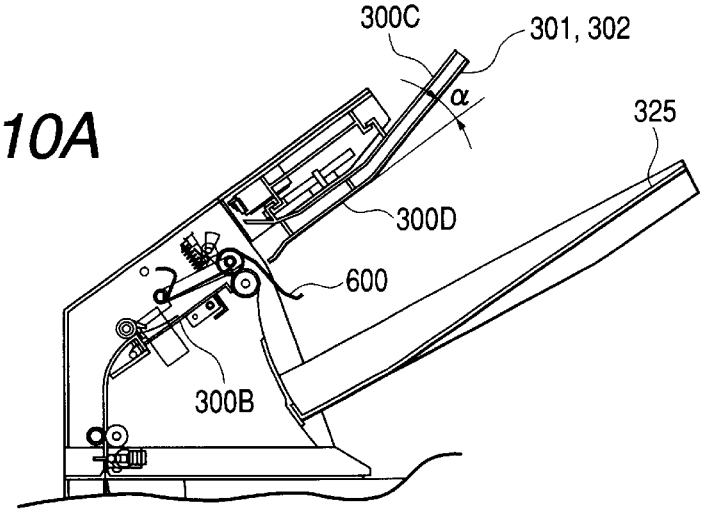
FIGS. 10A, 10B and 10C are views illustrating a full load detecting flag provided in a sheet treating apparatus in accordance with a second embodiment.
Figure 10B:
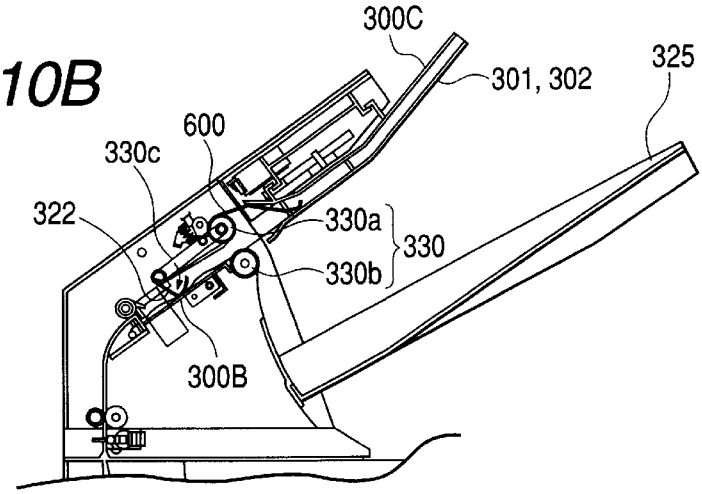
Figure 10C:
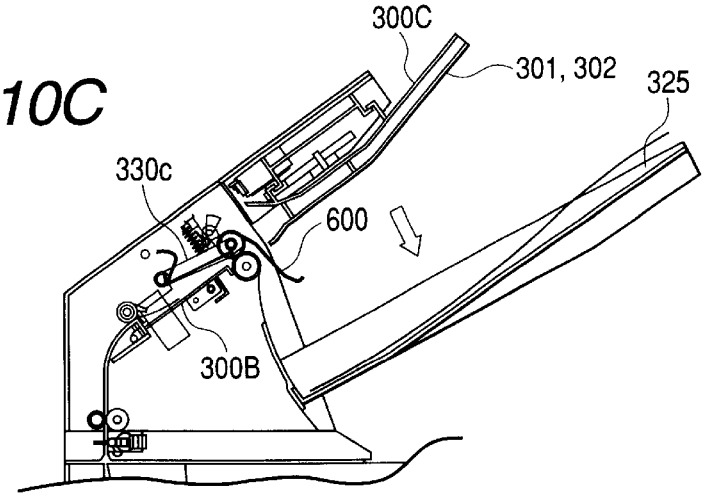
Figure 11:
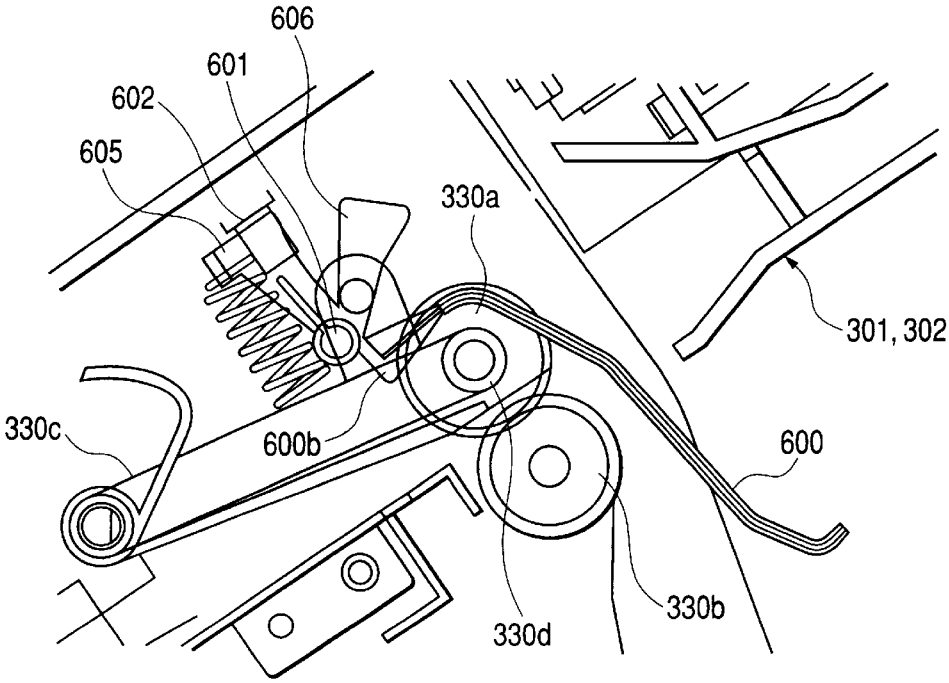
FIG. 11 is a partially enlarged view of FIG. 10A illustrating the full load detecting flag provided in the sheet treating apparatus in accordance with the second embodiment.
Figure 12:
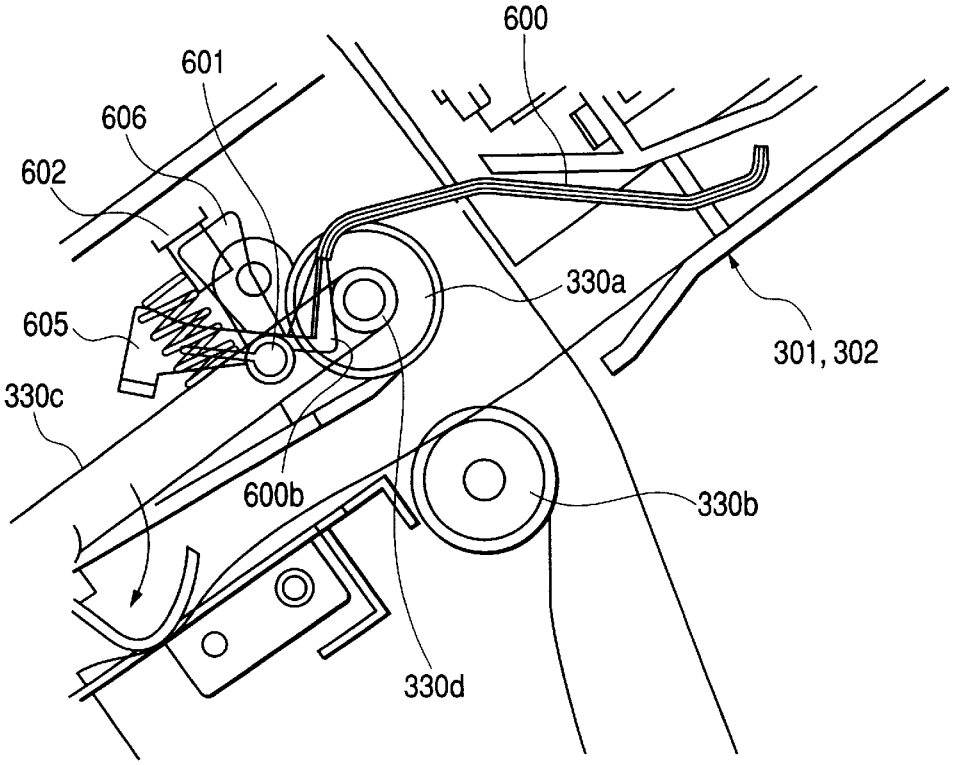
FIG. 12 is a partially enlarged view of FIG. 10B illustrating the full load detecting flag provided in the sheet treating apparatus in accordance with the second embodiment.

Next, a second embodiment of the present invention will be described. Note that, since general structures of an image forming apparatus main body and a sheet treating apparatus of this embodiment are substantially the same as those in the first embodiment, descriptions of the structures will be omitted here. FIGS. 10A, 10B, 10C, 11, and 12 are views illustrating the second embodiment. FIG. 11 is a partially enlarged view of FIG. 10A, and FIG. 12 is a partially enlarged view of FIG. 10B.

FIG. 10A shows an initial state, in which the full load detecting flag 600 has two photosensor light shielding portions 605 and 606 and shields the photosensor 602 from light in two portions of the two photosensor light shielding portions 605 and 606 according to a rotation angle of a flag. In FIG. 10A (FIG. 11), the photosensor 602 is shielded from light by the photosensor light shielding portion 605, and sheets can be stacked on the sheet stacking portion 325. Consequently, in the case in which the full load detecting flag 600 is lifted by the arm 330*c* (second position), that is, at the time of alignment and stack on the second intermediate stacking portion 300C, instead of stopping in terms of software the function of full load detection, that is, a sequence for determining whether or not sheets are fully stacked on the sheet stacking portion 325 (whether the photosensor 602 is transmitted light or shielded from light) in the case in which the full load detecting flag 600 is moved to the second position by the arm 330*c* in this embodiment, the photosensor 602 is shielded from light by the full load detecting flag 600 in terms of hardware as shown in FIG. 12 to create a state in which full load is not detected.

Consequently, a structure of software can be made less complicated and bugs of the software can be reduced.

(Third Embodiment)

Next, a third embodiment of the present invention will be described. Note that, since general structures of an image forming apparatus main body and a sheet treating apparatus of this embodiment are substantially the same as those in the first embodiment, descriptions of the structures will be omitted here.

Figure 13A:
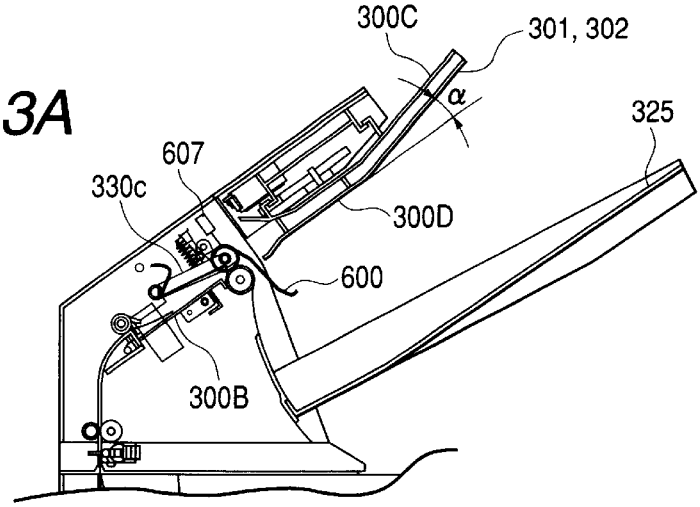
FIGS. 13A, 13B and 13C are views illustrating a full load detecting flag provided in a sheet treating apparatus in accordance with a third embodiment.
Figure 13B:
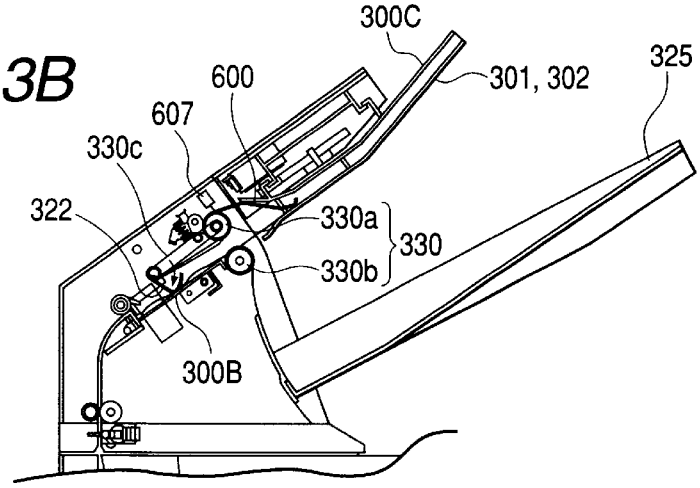
Figure 13C:
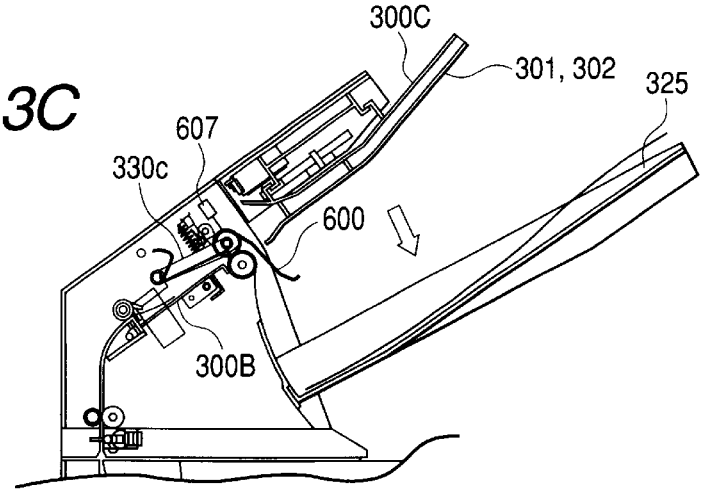

The full load detecting flag 600 of FIGS. 13A, 13B, and 13C is lifted by the solenoid 607 and is not linked to the arm 330*c*. That is, in this embodiment, the solenoid 607 is used as drive means for moving the full load detecting flag 600. Thus, although the arm 330*c* is lifted every time the full load detecting flag 600 is lifted in the initial operation at the time of jogger alignment in the first embodiment, this is unnecessary in the third embodiment. Since the arm 330*c* is biased downward by a spring and a large operation sound is emitted when the arm 330*c* is operated, it is preferable not to operate the arm 330*c* as much as possible and substitute another drive means (solenoid 607) for it in order to cope with the noise.

Consequently, troubles and noises are reduced, and pivotal response of a full load detecting flag is improved, whereby reduction of an initial time becomes possible.

(Fourth Embodiment)

Next, a fourth embodiment of the present invention will be described. Note that, since general structures of an image forming apparatus main body and a sheet treating apparatus of this embodiment are substantially the same as those in the first embodiment, descriptions of the structures will be omitted here.

Figure 14:
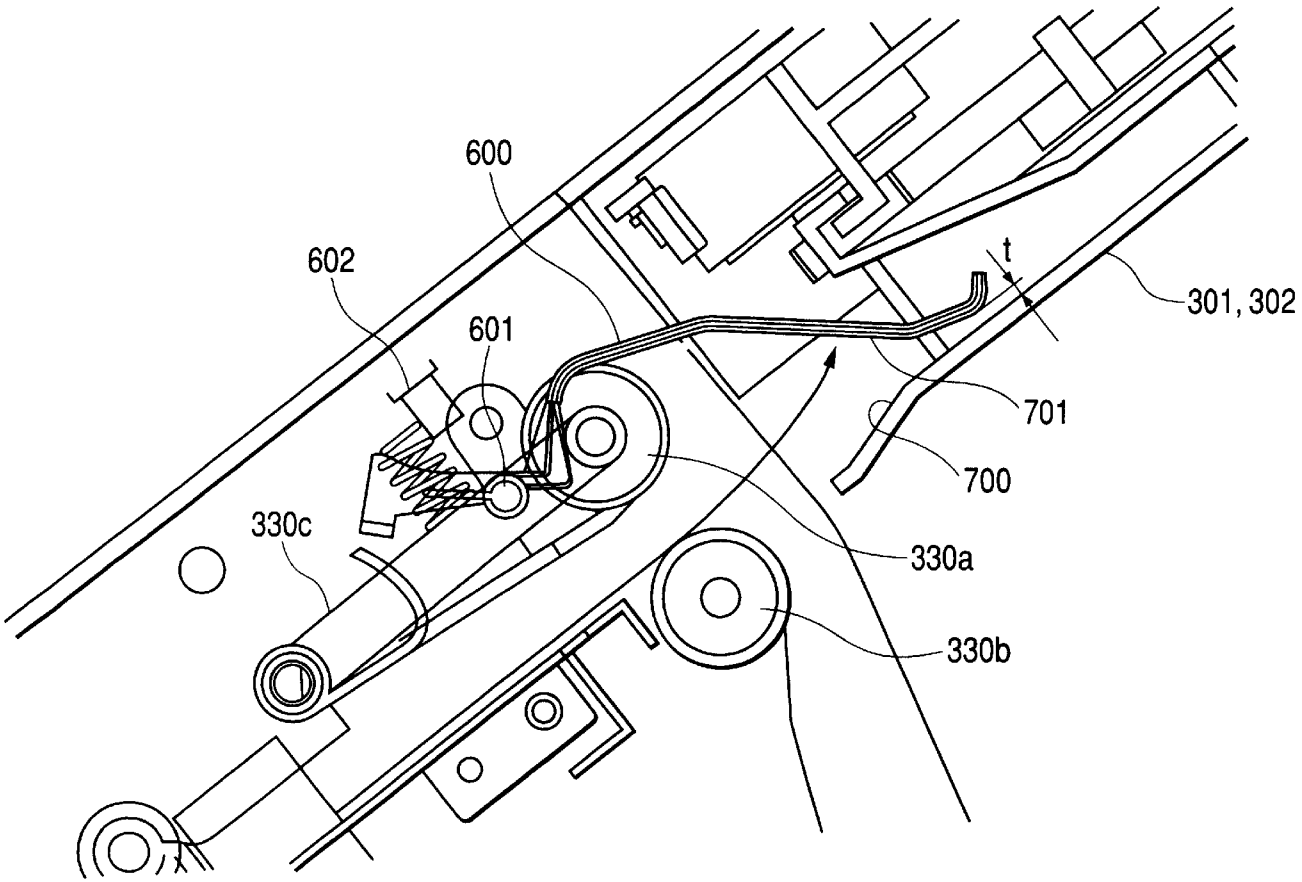
FIG. 14 is a view illustrating a full load detecting flag provided in a sheet treating apparatus in accordance with a fourth embodiment.

As shown in FIG. 9, the full load detecting flag 600 is brought into a state in which the full load detecting flag 600 is lifted by the cum surface 330*d* of the arm 330*c* with the pivotal center 601 as a center within the slide guides 301 and 302. Here, as shown in FIG. 9, a trumpet shape is formed by a guide upper surface 700 of the slide guides 301 and 302 and a flag lower surface 701 of the full load detecting flag 600 such that a sheet can be easily carried into the second intermediate stacking portion 300C through the pair of delivery rollers 330 spaced apart from the first intermediate stacking portion 300B. Consequently, when the sheet S is carried into the slide guides 301 and 302 (second intermediate stacking portion 300C) in a curled-up state (a state in which a sheet is curled to an upper surface side) as shown in FIG. 14, the guide upper surface 700 and the flag lower surface 701 perform the function for guiding the sheet S into the slide guides 301 and 302. When the full load detecting flag 600 is pushed by a predetermined or stronger force as the sheet S abuts against it, the full load detecting flag 600 pivots upward to relax curling of the sheet S.

As described above, according to this embodiment, when sheets are stacked on the second intermediate stacking portion 300C, the full load detecting flag 600 is pivoted using the arm 330*c* serving as drive means to cause the lower surface 701 of the full load detecting flag 600 to function as an upper side guide for guiding a sheet to be guided into the second intermediate stacking portion 300C. Consequently, sheet transport jam at the time when a sheet is carried into the second intermediate stacking portion 300C can be reduced.

(Fifth Embodiment)

Next, a fifth embodiment of the present invention will be described. Note that, since general structures of an image forming apparatus main body and a sheet treating apparatus of this embodiment are substantially the same as those in the first embodiment, descriptions of the structures will be omitted here.

Figure 15:
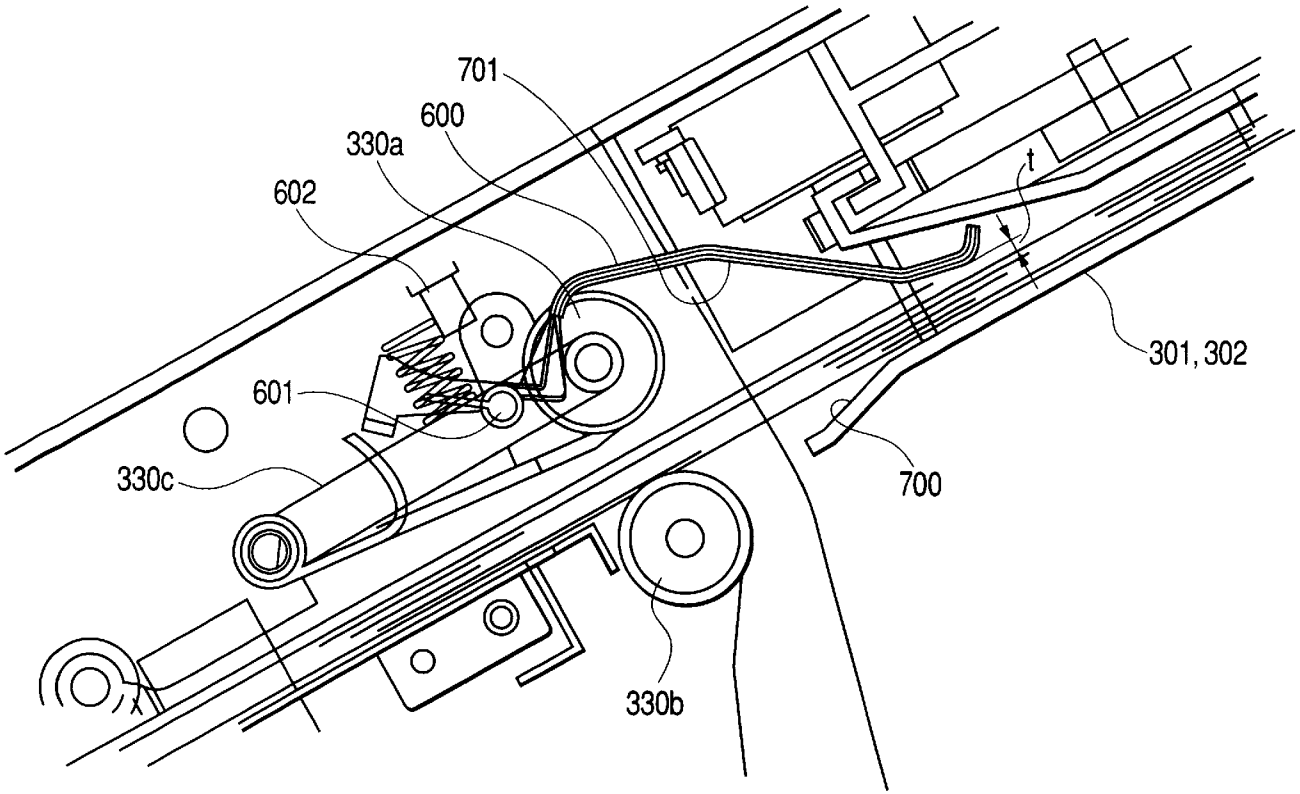
FIG. 15 is a view illustrating a full load detecting flag provided in a sheet treating apparatus in accordance with a fifth embodiment.

In this embodiment, the full load detecting flag 600 is constituted such that a rotation angle of the same can be changed in a plurality of steps by drive means (not shown). This allows a predetermined gap amount "t," which is most suitable for sheet transport shown in FIG. 14, to be substantially maintained even in a state in which a plurality of sheets are stacked as shown in FIG. 15 when sheets are stacked on the second intermediate stacking portion 300C. Therefore, it is driven by the drive means (not shown) by an average pivoting amount of the full load detecting flag 600 estimated in advance every time a sheet is delivered. Even if the number of sheets to be stacked on the second intermediate stacking portion 300C varies, since a guide for carrying in sheets is formed by the full load detecting flag 600 under substantially the same conditions, sheet transport jam can be further reduced.

In addition, it goes without saying that detection means for detecting a thickness of a sheet stack may be provided to control a position of a full load detecting flag based on data of the thickness.

(Sixth Embodiment)

Next, a sixth embodiment of the present invention will be described. Note that, since general structures of an image forming apparatus main body and a sheet treating apparatus of this embodiment are substantially the same as those in the first embodiment, descriptions of the structures will be omitted here.

Figure 16:
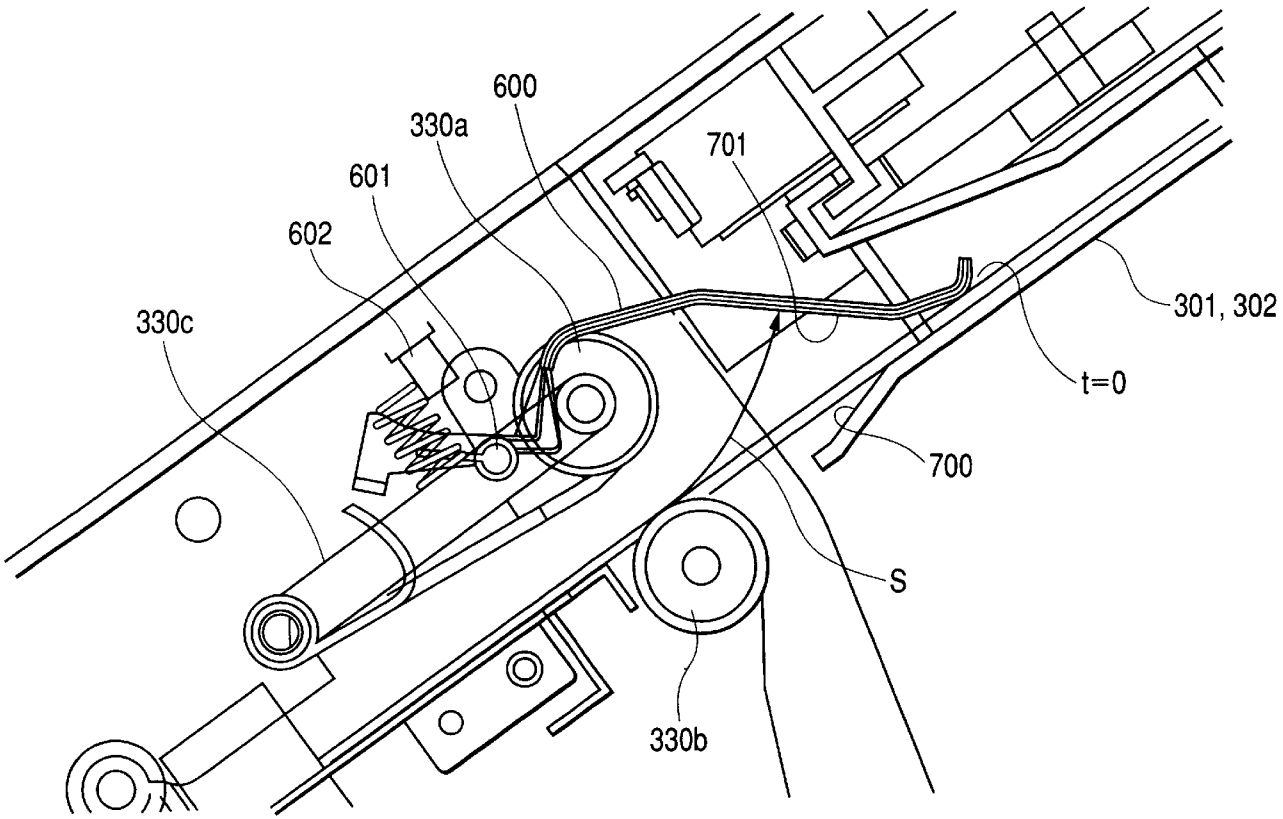
FIG. 16 is a view illustrating a full load detecting flag provided in a sheet treating apparatus in accordance with a sixth embodiment.

In this embodiment, as shown in FIG. 15, a gap amount "t" is maintained to be constant at the time when a sheet is carried in. After the sheet is transported to the second intermediate stacking portion 300C, the gap amount "t" is set to zero as shown in FIG. 16 to bias an upper surface of a sheet stack at the time of alignment by the slide guides 301 and 302 with the aid of the gravitational force of the full load detecting flag 600 before the sheet is aligned by the slide guides 301 and 302. Consequently, a sheet curled on both side ends in a cross direction is uncurled, and an alignment property is improved.

What is claimed is:

1. A sheet treating apparatus for treating a sheet delivered from an image forming apparatus main body, comprising:

a first intermediate stacking portion for hitting an edge of the sheet in a transport direction of the sheet against a wall to align the sheet;

delivery means for delivering the sheet from the first intermediate stacking portion;

a second intermediate stacking portion provided with a function for carrying-in and supporting the sheet downstream of the delivery means in the transport direction and aligning edges of the sheet in a cross direction perpendicular to the transport direction;

a sheet stacking portion located below the second intermediate stacking portion in a gravitational direction; and full load detecting means for detecting full load of sheets on the sheet stacking portion, wherein the full load detecting means contact an upper surface of sheets on the sheet stacking portion with a full load detecting flag, which has a pivotal fulcrum in a higher position than that of the delivery means, to detect a height of the upper surface, and does not perform full load detection of sheets during a sheet treatment in the intermediate stacking portions.

2. A sheet treating apparatus according to claim 1, wherein the full load detecting flag is movable between a first position in which full load detection of sheets is performed and a second position in which full load detection of sheets is not performed.

3. A sheet treating apparatus according to claim 2, wherein the full load detecting flag is movable between the first position and the second position using drive means.

4. A sheet treating apparatus according to claim 2, wherein the full load detecting flag is moved to the second position and does not perform the full load detection of sheets during the sheet treatment in the intermediate stacking portions.

5. A sheet treating apparatus according to claim 1, wherein the full load detecting flag has two light shielding portions for shielding a photosensor from light, and one of the light shielding portions is a light shielding portion for detecting whether or not sheets are fully loaded on the sheet stacking portion and the other light shielding portion is a light shielding portion for not performing the full load detection of sheets.

6. A sheet treating apparatus according to claim 5, wherein the full load detection is performed by detecting that the one light shielding portion is in a light transmission state for a predetermined time or more with the full load detecting means.

7. A sheet treating apparatus according to claim 1, wherein a stapler for applying a stitch treatment to the delivered sheet is provided.

8. A sheet treating apparatus according to claim 1, wherein the full load detecting flag has a pivotal fulcrum above a sheet delivery port, from which a sheet is delivered by the delivery means, and is pivotable by drive means around the pivotal fulcrum, and, wherein when a sheet is carried into the second intermediate stacking portion, the full load detecting flag pivots to a position in which a lower surface of the full load detecting flag functions as an upper side guide for guiding an upper surface side of the sheet to be carried into the second intermediate stacking portion.

9. A sheet treating apparatus according to claim 8, wherein, at the time when a sheet is carried into the second intermediate stacking portion, the full load detecting flag varies a rotation angle successively to vary a gap amount of a sheet carrying-in portion with respect to the second intermediate stacking portion depending on a number of sheets to be carried onto the second intermediate stacking portion.

10. A sheet treating apparatus according to claim 8, wherein when the edges of the sheet in the cross direction are aligned on the second intermediate stacking portion, an upper surface of the sheet is biased by the full load detecting flag successively.

11. A sheet treating apparatus according to claim 8, wherein a stapler for applying a stitch treatment to the delivered sheet is provided.

12. An image forming apparatus comprising:

an image forming apparatus main body for forming an image on a sheet; and a sheet treating apparatus according to any one of claims 1 to 11 for treating a sheet delivered from the image forming apparatus main body.

* * * * *

UNITED STATES PATENT AND TRADEMARK OFFICE

CERTIFICATE OF CORRECTION

PATENT NO. : 6,722,646 B2
DATED : April 20, 2004
INVENTOR(S) : Junichi Sekiyama et al.

It is certified that error appears in the above-identified patent and that said Letters Patent is hereby corrected as shown below:

Column 1,
Line 20, “of” should be deleted.

Column 3,
Line 35, “applied” should read -- applied, --; and
Line 37, “them” should read -- the following embodiments --.

Column 4,
Line 6, “stack” should read -- stacks --.

Column 6,
Line 46, “arm 33c” should read -- arm 330c --; and
Line 58, “inclination a” should read -- inclination α --.

Column 7,
Line 42, “consists” should read -- consist --.

Column 11,
Line 48, “form” should read -- from --.

Column 14,
Line 48, “contact” should read -- contacts --.

Signed and Sealed this

Tenth Day of August, 2004

JON W. DUDAS
*Acting Director of the United States Patent and Trademark Office*